US005081745A

United States Patent [19]

Siegenthaler

[11] Patent Number: 5,081,745

[45] Date of Patent: Jan. 21, 1992

[54] DEVICE FOR ROTATING TEXTILE MATERIAL CONTAINERS

[75] Inventor: Marcel Siegenthaler, Effretikon, Switzerland

[73] Assignee: Maschinenfabrik Rieter AG, Winterthur, Switzerland

[21] Appl. No.: 605,825

[22] Filed: Oct. 30, 1990

[30] Foreign Application Priority Data

Nov. 7, 1989 [CH] Switzerland ..... 04015/89

[51] Int. Cl.[5] ..... B65H 54/80

[52] U.S. Cl. ..... 19/159 R

[58] Field of Search ..... 19/0.25, 157, 159 R, 19/159 A; 57/78, 90, 127.5, 281, 408

[56] References Cited

U.S. PATENT DOCUMENTS

| | | | |
|---|---|---|---|
| 2,816,328 | 12/1957 | Carmichael et al. | 19/159 R |
| 2,908,945 | 10/1959 | Carmichael | 19/159 R |
| 2,936,496 | 5/1960 | Walter | 19/159 R |
| 3,299,479 | 1/1967 | Nivens | 19/159 R |
| 3,489,473 | 1/1970 | Goodwin et al. | 19/159 R |
| 3,612,457 | 10/1971 | Takashi | 19/59 R |
| 3,848,297 | 11/1974 | Ohashi et al. | 19/159 R |
| 3,955,243 | 5/1976 | Binder | 19/159 R |
| 4,102,016 | 7/1978 | Pak et al. | 19/159 R |
| 4,150,534 | 4/1979 | Raasch | 19/159 A X |
| 4,228,563 | 10/1980 | Weber | 19/159 R |
| 4,261,079 | 4/1981 | Masini et al. | 19/159 R |

FOREIGN PATENT DOCUMENTS

| | | | |
|---|---|---|---|
| 069087 | 6/1982 | European Pat. Off. . | |
| 270164 | 11/1987 | European Pat. Off. . | |
| 0255880 | 2/1988 | European Pat. Off. | 19/159 R |
| 2518491 | 11/1976 | Fed. Rep. of Germany | 19/159 R |
| 2907355 | 9/1980 | Fed. Rep. of Germany | 19/159 R |
| 3305496 | 8/1984 | Fed. Rep. of Germany | 19/159 R |
| 2646313 | 7/1986 | Fed. Rep. of Germany . | |
| 3734258 | 4/1989 | Fed. Rep. of Germany . | |
| 0751409 | 9/1933 | France | 19/159 A |
| 1525570 | 5/1968 | France . | |
| 2053443 | 4/1971 | France | 19/159 R |
| 2247414 | 5/1975 | France . | |
| 0012264 | 2/1981 | Japan | 19/159 R |
| 0278487 | 9/1973 | U.S.S.R. | 19/159 R |
| 1219514 | 3/1986 | U.S.S.R. | 19/159 R |
| 17252 | of 1915 | United Kingdom . | |
| 0302106 | 12/1928 | United Kingdom | 19/159 R |

OTHER PUBLICATIONS

Standard Search Report 6-8-90.

*Primary Examiner*—Werner H. Schroeder
*Assistant Examiner*—Ismael Izaguirre
*Attorney, Agent, or Firm*—Dority & Manning

[57] ABSTRACT

The rotator comprises a revolving plate, which is supported on bearing rollers, and a radial guide. The revolving plate forms a depositing place for a textile material holder and rotates with the holder on its longitudinal axis and is movable with the holder in the direction along the longitudinal axis. A sensor serves for measuring the movements of the revolving plate, for determining if the material holder is present and whether it is full or empty. The revolving plate has a guide element and the bottom of the container has a corresponding counterpart element. An opening in the bottom of the container and in the revolving plate makes position measurements of a spring plate carried in the material holder possible by means of a sonic measuring device.

13 Claims, 1 Drawing Sheet

DEVICE FOR ROTATING TEXTILE MATERIAL CONTAINERS

BACKGROUND OF THE INVENTION

The invention relates to a device for the rotation of textile material containers on their longitudinal axis, whereby the textile machine container is provided with a revolving plate with a drive.

Revolving plates for the movement of textile material containers are known in the textile industry, as for example, in the use of fiber sliver cans. According to the German Patent Specification DE 26 46 313, a revolving plate is assigned to a spinning machine, for example, on which four fiber sliver cans are placed. This revolving plate serves the purpose of placing the fiber sliver cans into a change position, where they are taken from the revolving plate serves the purpose of placing the fiber sliver cans into a change position, where they are taken from the revolving plate by means of a handling device, or they can be put down on this. With revolving plates of this type, the textile material container must be brought into a determined working position through additional devices, as the revolving plate is only suitable for the changing movement.

With automated textile installations, the need exists for revolving some textile material containers on their longitudinal axis. The revolving plates generally known in textile machine construction are suitable for rotating the plate on their axis, but they cannot meet the further requirements of automated textile machines and installations.

SUMMARY OF THE INVENTION

It is the object of the present invention to provide a device for rotating textile material containers, with which the textile material container is automatically put down correctly in the determined position, the presence of an empty or full container is determined, and the device makes further measurements on the textile material container possible, as, for instance, the level of the revolving plate, whereby this device can be used on textile machines as well as on transport vehicles.

The revolving plate according to the invention is intended for the acceptance of single textile material containers. The advantages of the invention exist in that the revolving plate is supported underneath by bearing rollers in the axial direction, whereby these bearing rollers are developed so that the revolving plate remains movable in the direction of the axial support. In this way, the revolving plate can be supported on weight measuring or movement measuring elements, or sensors, and, as a result, it is possible to determine from the movements or loading of the revolving plate whether the textile material container is arranged on the revolving plate and whether it is full or empty. The guide element on the upper side of the revolving plate and the mating counterpart on the bottom of the textile material container bring about exact positioning of the textile material container on the revolving plate during the depositing movement. The guide element also prevents a transverse displacement of the container to the longitudinal axis.

The drive of the revolving plate can be effected through known rotary drives or, in an advantageous way, through a friction wheel drive arranged under the revolving plate, whereby the friction wheel is pressed against the lower surface of the revolving plate and is slidable in the pressure direction. The use of a device for the measurement of the movement in the pressure direction, as well as the arrangement of the friction wheel on a rocker with a spring element gives the advantage that the containers placed on the revolving plate produce the pressure on the friction wheel, as the revolving plate is movable in the axial direction. In addition, the rocker movement can be determined by the movement of the revolving plate and checked through this whether a container is present on the revolving plate or not. The arrangement of an opening in the center of the revolving plate and in the bottom of the container makes the arrangement of a measuring sensor underneath the revolving plate possible. With this opening, the position of the plate spring in the textile material container can be determined. Through this opening it can be determined on the container which has been put down, whether, and how much, textile material is present in the container. The plate spring is formed in a known way and moves along the longitudinal axis of the container, depending on the weight of the textile material present.

The arrangement of the revolving plate according to the invention makes possible the exact positioning of the container during the transport operation between two different textile machines or between two different depositing positions. With filled textile material containers, it is possible through the invention to bring the sliver end, which hangs over the rim of the upper can, into a suitable delivery or take over position. Moreover, the arrangement of the device according to the invention on a textile machine also has the considerable advantages described. As all the movements of the revolving plate of the textile material container and of the plate spring can be measured and determined by sensors, then the appropriate known control arrangements can be actuated by means of the measurement signals, whereby these control arrangements and the appropriate drives can be operated fully automatically. Through the invention a substantial improvement of the transport and movement progress of textile materials in textile installations and textile machinery systems is attained and an increased degree of automatization is effected.

BRIEF DESCRIPTION OF THE DRAWINGS

In the following, the invention is described more closely with the aid of the drawings. These show.

DESCRIPTION OF THE PREFERRED EMBODIMENT

Figure 1:
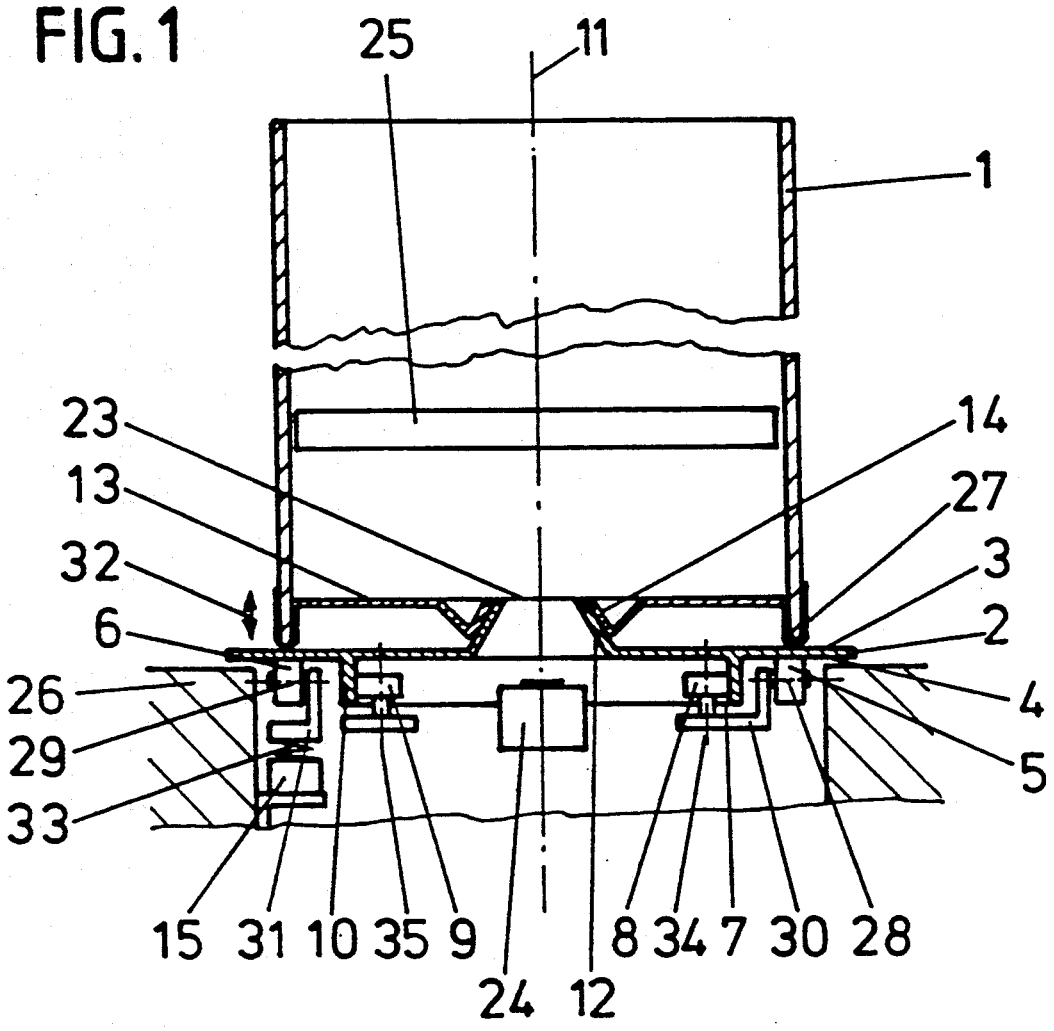
FIG. 1 is a sectional view through a revolving plate with textile containers placed in position in a simplified representation.

FIG. 1 shows a textile material container 1 with a container bottom 13 and a spring plate 25. The springs, which hold the spring plate 25 in balance with the textile material in the container 1, are formed in the known way and are not shown in the embodiment illustrated. The textile material container 1 has a circular cross section and is supported on a revolving plate 2. Revolving plate 2 is built into a transport vehicle 26, whereby this transport vehicle serves for the transport of the textile material container 1 between various textile machines and the depositing and/or repair points. The transport vehicle 26 is equipped with automatic steering and has, in addition, a means, not shown, which serves for the manipulation of the textile material container 1. The revolving plate 2 lies in the outside area on bearing rollers 5, 6, whereby these bearing rollers form axial bearings. The rim 27 of the container bottom 13 also lies in the area of these bearing rollers 5, 6. Through this arrangement, a suitable distribution of the reaction on the support is ensured. The bearing rollers 5, 6 are rotatable on the horizontal axes 28, 29 and supported on the supporting elements 30, 31. The supporting element 31 is movable in the direction of the arrow 32 and lies on a spring element 33. There is a sensor 15 underneath this supporting element 31, by means of which the position of the supporting element 31 and the revolving plate 2 is determined in this area.

If a textile material container 1 is not on the revolving plate 2, then the spring element 33 presses the supporting element 31 upwards in this area and therewith the bearing roller 6 as well as the revolving plate. This is possible, because the revolving plate 2 can be moved in the direction of the axial support, or of the longitudinal axis 11. If a full textile material container 1 is put on the revolving plate 2, then the revolving plate 2 and, therewith, the bearing roller 6 with the supporting element 31 is pressed downward until the load is balanced with the spring element 33. These movements of the supporting element 31 are measured by means of the sensor 15 and the corresponding measured values serve for the production of the control signals with the information as to whether textile material container 1 is present and, with a suitable embodiment, whether this container 1 is full or empty.

The mobility of the revolving plate 2 is ensured in that the revolving plate 2 with the underside 4 lies loosely on the bearing rollers 5, 6 and is positioned with reference to the rotary movement about the longitudinal axis 11 through a radial guide 7. This radial guide 7 consists of guide ring 10 connected with the revolving plate 2 as well as radial rollers 8, 9 which lie on the inner side of the guide ring 10. Radial rollers 8, 9 are rotatable on the axes 34, 35 and are likewise supported by a supporting element 30. The rolling surfaces of the radial rollers 7, 8 are convex in shape, so that an inclined position of the revolving plate 2 does not lead to the jamming and the rotary movements are not prevented.

In the center of the revolving plate 2, a guide element 12 is arranged on the upper side 3, which consists of the shell surface of a truncated cone. On the bottom 13 of the container 1 a corresponding counterpart 14 is present which, with a deposited container 1, mates with the guide element 12. This counterpart 14 consists of a conically formed shell ring with dimensions which correspond to the guide element 12. If a textile material container 1 is put down on the revolving plate 2, and its longitudinal axis 11 is not in the center of the revolving plate 2, then the container 1 is deflected with the aid of the guide element 12 and guided to the desired position on the revolving plate 2. With a deposited container, the mating counterpart 14 working with the guide element 12 prevents displacement of the container 1 transverse to the longitudinal axis 11. The conical surfaces of the guiding surface 12 and the counterpart 14 bring about static friction which is sufficient to turn the container 1 with the revolving plate 2 with relatively high acceleration without slipping.

There is a further measuring device 24 underneath the revolving plate 2 which contends a ultrasonic sensor and an appropriate measured value converter. By means of this measuring device, ultrasonic waves are transmitted in the direction of the spring plate 25 in the textile material container 1, and the reflected waves from the spring plate 25 are received. Through this device, the distance between the measuring device 24 and the spring plate 25 can be determined in a way which is well known, and therewith, the position of the spring plate 25 within the textile material container 1 is known. In order to make this measurement possible, openings 23 are arranged in the center of the revolving plate 2 and the bottom of the container 13, through which the supersonic waves can penetrate. With the embodiment in FIG. 1, a known drive is available, now shown, which produces the rotary movement of the revolving plate 2 about the longitudinal axis 11 and therewith that of the material container 1. The drive (which is not shown) can act on the radial rollers 8 or 9 or directly on the revolving plate 2 or the guide ring 10.

Figure 2:
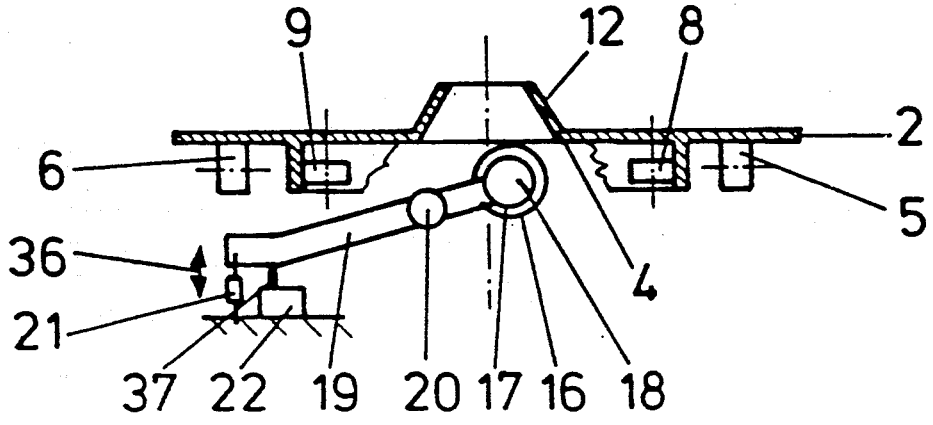
FIG. 2 is a sectional view of a revolving plate with a friction wheel drive in a schematic representation.

In FIG. 2, the drive of the revolving plate 2 and is represented with a friction wheel drive 16. The revolving plate 2 and its support on the bearing rollers 5, 6 as well as on the radial rollers 8, 9 correspond to the embodiment according to FIG. 1. In opposition to FIG. 1, however, the bearing roller 6 is not movable and is fixed as is the bearing roller 5. It is expedient when the revolving plate 2 is supported on three bearing rollers 5 or 6. A rocker is arranged underneath the revolving plate 2, which pivots on an axis 20. On one end of this rocker 19, the friction wheel drive 16 is supported, which consists of a friction wheel 17 and the appropriate driving motor 18. The friction wheel 17 lies on the underside 4 of the revolving plate 2 and produces the rotary movement of the revolving plate 2. On the outer end of the rocker 19, a spring element 21 is built in, which produces the necessary contact pressure for the friction wheel 17 and which, additionally, is capable of lifting the empty revolving plate 2 in the direction of the axial support. This spring element 21 brings about movement of the outer end of the shaft 19 in the direction of the arrow 36 and opposite movement on the other end of the rocker shaft 19, as it pivots on the axis 20. In addition to the spring element 21, a position measuring element 22 is also present in the area of the rocker shaft 19. This position measuring element includes a position feeler 37, which transmits the movements of the shaft 19 on the position measuring element 22. The position measuring element 22 produces corresponding measured values and control signals in the known way, which are, again, used to determine whether a textile material container 1 is present, and, if desired, whether it is full or empty. In addition, the position measuring element 22 also serves the purposes of only setting the friction wheel drive 16 in operation when a textile material container 1 is put down on the revolving plate 2.

The embodiments represented in FIGS. 1 and 2 are built into a transport vehicle 26 for textile material container 1. The same arrangement for revolving textile material containers 1 on the longitudinal axis 11 can, however, also be built into textile machines or in other auxiliary arrangements in textile installations. They bring substantial advantages everywhere where textile material containers 1 must be determined automatically whether a certain textile material container is present on a revolving plate 2 or not. A further substantial advantage is acquired in that it can be determined that, when a textile material container 1 is put down on the revolving plate 2, on which level the plate spring 25 is to be found inside the container 1, that is, how much material is still in the container 1. All these measurements can be processed automatically and used for the automatic control of appropriate textile installations. Furthermore, the apparatus is of simple design and is not prone to disturbances.

What is claimed is:

1. Apparatus for supporting textile material for supplying textile machinery, comprising:

(a) a container supporting plate supported on supporting and guide rollers for rotation about a vertical axis, and being movable in the direction of said vertical axis and said supporting plate having an aligning and driving surface for engaging a bottom of a container for said textile material, said supporting plate laying loosely on said supporting rollers;

(b) said container for holding said textile material having said bottom with an aligning and supporting surface mating with said aligning and driving surface of said supporting plate to align a longitudinal axis of said container with said vertical axis of said supporting plate for rotation about said axis;

(c) drive means for rotating said supporting plate and therefore said container about said vertical axis;

(d) a guide ring connected to the underside of said support plate, said guide ring and said guide rollers forming a radial guide to said support plate; and (e) supporting elements for said support rollers, at least one of said supporting elements being movable in the direction of said vertical axis and being springloaded.

2. Apparatus as set forth in claim 1, further comprising central portions of said aligning and support surface of said container bottom and said aligning and driving surface of said support plate are conical.

3. Apparatus as set forth in claim 1, wherein said aligning and support surface of said container bottom and said aligning and drive surface of said support plate are truncated cones.

4. Apparatus as set forth in claim 1, wherein said support plate and said container bottom have central openings.

5. Apparatus as set forth in claim 4, wherein said container has a spring plate inside of said container for supporting textile material contained therein and measuring means are located below said support plate opposite said central openings in said support plate and said container bottom for measuring the position of the spring plate in said container.

6. Apparatus as set forth in claim 5, wherein said measuring means opposite said openings comprise ultrasonic sensors.

7. Apparatus as set forth in claim 1, further comprising sensing means for sensing movement for said support plate along said vertical axis.

8. Apparatus as set forth in claim 7, wherein said sensing means is disposed on one of said support rollers.

9. Apparatus as set forth in claim 1, wherein said drive means comprises a friction wheel drive supported under said support plate and said friction wheel is pressed against the underside of said support plate and said friction wheel is movable along the said vertical axis.

10. Apparatus as set forth in claim 9, further comprising measuring means for measuring movements of said friction wheel along said vertical axis.

11. Apparatus as set forth in claim 10, wherein said friction wheel is supported on one end of a rocker shaft and the other end of said rocker shaft is connected to a spring element and said measuring means, said spring element urging said friction wheel into driving contact with said support plate.

12. Apparatus as set forth in claim 1, wherein said support plate is supported by a vehicle for transporting textile material containers.

13. An apparatus for supporting textile material for supplying textile machinery, comprising:

(a) a container supporting plate supported on supporting and guide rollers for rotation about a vertical axis, said supporting plate having an aligning and driving surface for engaging a bottom of a container for said textile material;

(b) said container for holding said textile material having said bottom with an aligning and supporting surface mating with said aligning and driving surface of said supporting plate to align a longitudinal axis of said container with said vertical axis of said supporting plate for rotation about said axis;

(c) sensing means sensing the movement of said support plate along said vertical axis;

(d) said sensing means being disposed on one of said supporting rollers; and (e) drive means for rotating said supporting plate and therefore said container about said vertical axis.

* * * * *